United States Patent [19]

Webster

[11] 4,137,615

[45] Feb. 6, 1979

[54] PROCESS FOR TEXTURING BICOMPONENT YARN

[75] Inventor: Michael T. Webster, Madison, N.C.

[73] Assignee: Burlington Industries, Inc., Greensboro, N.C.

[21] Appl. No.: 802,544

[22] Filed: Jun. 1, 1977

[51] Int. Cl.[2] ..... D04B 1/26; D02G 1/00

[52] U.S. Cl. ..... 28/218; 28/154; 66/178 A; 66/202

[58] Field of Search ..... 28/218, 154; 66/178 A, 66/202

[56] References Cited

U.S. PATENT DOCUMENTS

| | | | |
|---|---|---|---|
| 3,566,622 | 3/1971 | Iannucci | 28/218 X |
| 4,057,880 | 11/1977 | Matthews et al. | 28/218 X |

FOREIGN PATENT DOCUMENTS

| | | | |
|---|---|---|---|
| 4527067 | 9/1970 | Japan | 28/218 |

OTHER PUBLICATIONS

*Producing Knit-de-Knit Yarns,* Man Made Textiles, pp. 30, 31, 33, Jun. 1967.

*Primary Examiner*—Robert Mackey

*Attorney, Agent, or Firm*—Cushman, Darby & Cushman

[57] ABSTRACT

A method for producing conventionally usable, stable, preshrunk and crimped yarn from greige self-crimping bicomponent or biconstituent yarn. The method employs a knit-de-knit procedure to impart a so-called mechanical crimp in the self-crimping yarn as that yarn is subjected to an initial heat treatment. The knit-de-knit process has been modified in order to knit the knit-de-knit tubular sleeve more loosely and to obtain a crimp rate per thread line inch within a predetermined range. The knit tubular sleeve is collected in the form of a fabric roll, the internal diameter of which is controlled so that during heating the yarn crimp can develop uniformly. The yarn produced thereby can be used to produce "to size" greige fabric or garments which exhibit better snag or pick resistance than such fabrics or garments produced from conventional greige yarn. These fabrics or garments can thereafter be subjected to normal finishing procedures.

8 Claims, 4 Drawing Figures

PROCESS FOR TEXTURING BICOMPONENT YARN

BACKGROUND OF THE INVENTION

Over the years, since the first introduction of man-made fibers into the textile industry, there has been an almost ceaseless quest for different techniques to make such man-made synthetic fibers appear like and be similar to natural fibers (e.g. cotton and wool). As part of this, most procedures have as at least part of the objective the increasing bulk of such man-made fibers in order to provide garments made therefrom with a soft, luxuriant hand, sufficient elasticity to provide a good fitting garment, increased moisture absorption for better wearing comfort and increased yarn volume to allow for more coverage.

The process of texturing or crimping in order to impart random loops or otherwise modifying continuous filament yarns to increase their cover, resilience, abrasion resistance, warmth, insulation and moisture absorbance or to provide a different surface texture can be broken down roughly into six main groups. These include air-jet texturing, edge crimping, false-twist texturing, gear crimping, knit-de-knit texturing and stuffer box crimping.

With the advent, however, of biconstituent yarns which are in effect self-crimping, an additional method of forming man-made yarns into textured-type products has evolved. One example of such a yarn is DuPont's N-780, now referred to as type #207, a side-by-side biconstituent yarn. Another example is Monvelle produced by Monsanto. This type of yarn is extremely sensitive to the application of heat and has an extremely high shrinkage rate characteristicly approaching 76%. Products produced from this yarn, after proper finishing exhibit very good anti-snagging or picking characteristics and thus is considered to be an extremely acceptable yarn for use in the production of ladies' hosiery.

While the yarn manufacture indicates and practice shows it to be possible to produce greige products directly from this yarn, one of the major drawbacks with employing such self-crimping yarns is that garments or fabrics produced therefrom have to be made in an extremely large size proportionialized according to the shrinkage characteristics of the yarn. If done correctly when the garments or materials are subjected to heat during dyeing and finishing, the shrinkage will bring the garments or fabrics to a proper size and at the same time develop the crimp and anti-snag characteristics of the yarn.

The theory of using such yarns has not worked well in practice at all times and there are several disadvantages to working with such yarn. In some instances production equipment would have to be modified to produce the necessarily oversized fabric or garment. It is somewhat difficult to gauge how large garments should be to produce predetermined sizes with the exactness required by today's consumers and, in fact, a fair amount of guess work is required before full-scale processing of such garments can be undertaken. This is quite inconvenient, especially when there are size changes or different stitch configurations which would cause variations in the amount of yarn being used which affect the ultimate size being obtained. The pick resistance of the oversized garment is extremely fragile and because the fabric made is so loose, it is extremely easy to have yarns somehow become damaged thereby producing an inordinately large number of seconds. On many occasions, one out of every three garments is lost between production and heat treating.

In view of such problems attendant to the use of this yarn, it was desired to be able to properly develop crimp in the yarn and to reduce the size of the yarn such that garments or fabrics could be made "to sizes" with any subsequent finishing or heating finishing operations serving to only develop even additional crimp in the yarn thereby improving the anti-snag properties of the yarn rather than altering the size of those fabrics or garments.

The knit-de-knit process as it is conventionally known is exemplified in the Page patent, U.S. Pat. No. 2,601,451. This patent relates to a method of making a stocking and has as one specific object the production of yarn through a knit-de-knit procedure. The patent discusses the problem called phasing with respect to the construction of hosiery items which occurs when there is a substantial correspondence between the frequency of the reoccurrence of the crimps in the formed yarn and the frequency of reoccurrence of the final knitted loops. Where these two frequencies tend to fall into phase, undesirable lines will appear usually referred to as phasing. Thus, any process for producing crimped yarn must be accomplished at a frequency where the reoccurrence of the crimps when used to make fabrics will not create phasing problems. The Page patent indicates that a standard 400-needle circular knitting machine is used to knit a tube of material which can be stretched to a circumference of 16½ inches or 30 inches. The knit tube is subsequently subjected to a shrinking or setting action at a temperature ranging between 225° F. to 250° F. Thereafter, the knit tube is unraveled and the yarn used in the production of garments. It should be pointed out, that the type of crimped yarn resulting from employing the process set forth in the Page patent would have a regular pattern of successive and uniformly spaced crimps, each of which would have the configuration of a knitted stitch loop.

A modification of the knit-de-knit process set forth in the Page patent is described in the Silver et al. patent, U.S. Pat. No. 3,330,018 dated July 11, 1967. The object of the Silver et al. patent was to obtain a crimped yarn which would include various portions of straight or uncrimped sections together with crimped sections so that when the yarn was knit or woven into a fabric, the fabric would have a novelty pattern with varying degrees of stretchability in various portions thereof. In accomplishing that objective, Silver et al. employed alternating knit and float sections with the number of needles used to form the alternating knit and float sections being variable in a random and preferably non-repeating manner.

It was found that when employing the hitherto conventional knit-de-knit crimping procedures together with conventional heat treating of the knit tubular sleeve, it would not serve to properly treat the bicomponent self-crimping yarn in a manner that would make it suitable for use as a conventional yarn in producing "to size" fabrics or garments.

SUMMARY OF THE PRESENT INVENTION

The present invention concerns a process and novel product resulting therefrom. The process pretreats self-crimping yarn so as to develop crimp in the yarn under but controlled conditions, so as to provide an essentially conventionally sized yarn suitable for knitting and/or weaving in which crimp has been developed and in which the latent shrinkage characteristics of the yarn have been substantially reduced if not eliminated. The present process employs a knit-de-knit approach but because of the nature of the yarn being treated, employs techniques and apparatus changes which are quite different from the so-called conventional knit-de-knit process as discussed above in reference to the Page patent. Likewise, the resulting product not only is rendered into a form which is useable in conventional knitting or weaving procedures, it also produces several unexpected yarn characteristics found to be extremely desirable especially in considering the manufacture of otherwise delicate articles, such as women's hosiery. The resulting product is quite resistant to snagging and picking, even in the subsequently produced greige garments, exhibits a crimped effect when in its final finished fabric form comparable to yarns which have been crimped by a plurality of crimping techniques and garments produced therefrom exhibit much better fit characteristics.

In accordance with the present invention, the applicant has found that through a combination of particular processing steps, the specific pretreating to develop crimp in bicomponent yarns, satisfactorily renders that bicomponent yarn suitable for use as a conventional yarn. In particular, applicant has found that by reducing the number of needles used to knit the tubular sleeve, by controlling the tension on the yarn being knit to limit yarn put in each course, by controlling and enlarging the internal diameter of the fabric roll when collecting the knit tubular sleeve and heat treating the fabric roll at a temperature between 221° F. and 265° F., it is possible to develop the bicomponent self-crimping yarn into a form suitable for knitting or weaving garments or fabrics to size in a normal fashion and simultaneously increase the pick resistance of that greige garment or fabric. With respect to the formation of hosiery, it has been found that the above processing when applied to bicomponent yarns also avoids and eliminates phasing problems which at times exist when using crimped yarn in the production of hosiery. It has also been found, after this yarn is used to produce garments, that subsequent finishing operations cause additional crimping in an already highly crimped yarn thereby producing additional crimping and novelty effects in the yarn to a greater extent than would heretofore have been possible with the use of bicomponent yarns. Garments produced from this preprocessed yarn are found to exhibit extremely good anti-snag and anti-pick properties which it is believed is due to the highly crimped nature of the yarn which essentially is crimped twice.

Other objects and advantages of the present process and improved yarn product will appear hereinafter as the description of the present invention proceeds in view of the following drawings.

Figure 1:
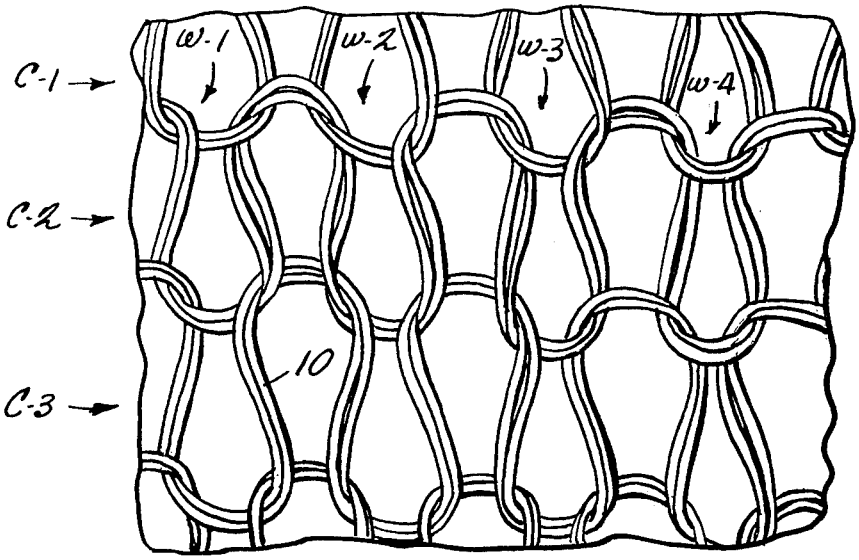
FIG. 1 is an enlarged fragmentary view of a portion of a knitted article illustrating the uncrimped configuration of yarns in stitch loops of a bicomponent greige yarn.

As pointed out hereinbefore, various types of composite self-crimping yarns have now been provided for use in the textile industry for use in knitting stretchable garments, such as women's hosiery. Examples of such composite self-crimping yarns, presently available to the textile industry, comprise two manufactured by E. I. DuPont de Nemours, Cantrece and N-780 now referred to by DuPont as number 207 and another manufactured by the Monsanto Textile Company called Monvelle. However, applicant would point out that the present process set forth herein lends itself to any bicomponent or biconstituent fiber combination which is self-developing or self-crimping through the application of heat.

Also as previously pointed out herein, the production of garments, such as panty hose, from bicomponent or biconstituent greige yarns has required the production of such garments to be accomplished in a greatly enlarged and oversized manner with a very loose or open stitch construction. Because of the greatly enlarged construction, and because of the relative fragility of the yarn, such garments are readily susceptible to being picked and snagged or otherwise injured during subsequent handling and processing steps. Therefore, companies such as DuPont have recommended that the garments be subjected to the heat treatment process as soon as the garment is created so as to develop the latent crimp in the yarn and reduce the garment to its correct size thereby reducing the likelihood that the garment will be picked or otherwise damaged during subsequent processing steps. Applicant has found, however, that notwithstanding the development of crimp at a very early state following the production of garments, because of the fact that the greige fabric is extremely fragile, upwards of one out of every three first quality garments produced are lost during processing steps prior to the heat process.

The process contemplated herein for suitably preparing self-crimping bicomponent and biconstituent type yarns for use as conventional yarns in the production of "to size" garments or fabrics involves the following steps.

The self-crimping, bicomponent or biconstituent yarn, usually received in the form of packages, are initially knit into a tubular sleeve, as is normally the case in knit-de-knit processing techniques. It has been found, that if an ordinary knit-de-knit knitting head, containing 400 needles, is employed not only is there a problem of having phasing occur when the yarn is subsequently used in the production of garments, but the resulting knit tubular sleeve is itself rendered too tight, in terms of its fabric construction, to unravel with sufficient ease. Thus, by controlling the needle count in a range between 200 and 400 needles, preferably using 340 needles, the fabric construction after autoclaving, is loose enough to unravel with ease and will not become bound in the fabric so as to create difficulty during unraveling or coning of the autoclaved and fully treated yarn.

In addition to employing a needle cylinder which is comprised of a lesser number of needles than is conventionally thought to be necessary in knit-de-knit processing, it has also been found that the yarn feed rate must be precisely controlled and held at a fairly constant level. By controlling the yarn feed rate, it assures that substantially each thread line inch of the treated yarn will exhibit a crimp rate ranging between 16 to 24 crimps per thread line inch. It has been found, that when using a C.B.-TEX KdK machine, a feed rate of about 27.5 inches to about 34 inches of yarn per revolution of the knitting cylinder was sufficient to achieve the 16 to 24 crimps per thread line inch requirement. By controlling the feed rate and thereby controlling the number or amount of crimps per inch in this fashion, a yarn is producible with which a wide variety of garment styles can be produced and phasing problems, which otherwise appeared, were effectively eliminated.

As the tubular sleeve is knit, it is continuously collected in the form of a fabric roll. It was found, that rather than using the conventional take-up device for the knit-de-knit machine, which varys between 2 to 5 inches in diameter, it was found necessary to produce a fabric roll which had an internal diameter that was substantially twice the diameter of the largest of otherwise conventional take-up devices. The fabric roll for the bicomponent yarn sleeve must have an internal diameter of at least 8 inches and preferably 10 inches so as to allow for uniform and maximum relaxation of the yarn and to allow full crimp development throughout the entire fabric roll. When smaller internal diameter rolls were treated, the shrinkage rate through the roll was not uniform. For this reason, the yarn characteristics throughout the fabric roll were not uniform or consistent which resulted in the creation of off-shaded portions in portions of the yarn when that yarn was formed into fabrics or garments and subsequently dyed. Because of the non-uniform shrinkage of the yarn, streaks and uneven dyeing appeared in those portions of the yarn which occupied an internal position within the fabric roll. By increasing the internal diameter of the fabric roll, all of the portions of the knit roll can uniformly relax and crimp can be uniformly developed during autoclaving so that the entire length of the yarns effectively have the same dye receptivity characteristics and are uniformly dyeable.

After the yarn has been formed into the tubular sleeve and collected in the form of fabric rolls, as described hereinabove, the fabric rolls are autoclaved at temperatures ranging between about 212° F. to about 265° F. with a preferred temperature of about 235° F. which yields a relatively high degree of shrinkage and crimp development and is also generally higher than subsequent processing temperatures to which the yarn is likely to be subjected by the ultimate users of such yarn. It has been found, that when autoclaving at temperatures below 212° F., the yarn will not be suitably shrunk nor will the latent crimp be fully developed and subsequent processing will usually involve treatment at temperatures higher than 212° F. which would cause further shrinkage and garment deformity.

It should also be pointed out that the heat treatment for the knit-de-knit fabric rolls can be accomplished in a heated liquid medium such as water or a chlorothene solvent. However, since the flash point for this solvent is 180° F., temperatures in excess of 180° F. are not recommended and crimp development can be accomplished at lower temperatures due at least in part to the moist conditions.

If autoclaving temperatures exceed 265° F., it has been found that the yarn itself will loose substantial portions of its tensile strength such that the fiber's remaining strength will not be within tolerable limits for customer use. Although it is believed that yarn shrinkage occurs almost immediately as the yarn is heated to the preset temperature within the above temperature range, autoclaving within these preferred ranges, and within the preferred area of about 235° F., will usually continue for about 20 to 50 minutes, preferably for about 45 minutes. Autoclaving for this period is preferred because it is essential to equalize temperatures within the fabric rolls, from the outside to the inside thereof and since fabric rolls vary somewhat in size, the heat treatment needs to continue for a period of time to allow that equalization to occur.

Following autoclaving, yarn is unraveled and formed into cones or packages depending upon the particular end use to which the yarn is to be put.

The following experiment is exemplary of the heat treatment to which the knit-de-knit fabric rolls are subjected and the type of results, in terms of shrinkage, which can be expected at various treatment times at 235° F.

Four knit-de-knit rolls were removed from production and checked. Each had an internal diameter of 10 inches, an outer diameter of 17 inches and weighed about 2.5 pounds. Each package was autoclaved under dry heat conditions at 235° F. with the following table showing treatment times and the percent shrinkage:

| Test No. | Treatment Interval | Percent Shrinkage |
|---|---|---|
| 1. | 10 minutes | 40% |
| 2. | 20 minutes | 45% |
| 3. | 30 minutes | 50% |
| 4. | 45 minutes | 60% |

As was pointed out hereinbefore the yarn manufactures indicate that for this type of yarn shrinkage rates of up to about 76% can be expected. I have found that when shrinking this yarn in the form of knit-de-knit fabric formed into rolls as described herein, the fabric is shrinking onto or into itself so that the entire package shrinks and tightens. As this tightening continues, the yarn is pulling against itself so that rather than getting shrinkage rates of 76%, the 60% shrinkage obtained when treated at 235° F. for 45 minutes constitutes effectively full or total shrinkage.

Turning now to FIG. 1, the figure shows essentially a tracing of a photo-micrograph of a portion of a knit fabric, knit from the griege form of the self-crimping bicomponent or biconstituent yarn prior to any processing. This is the form the fabric would take when knit in a greatly enlarged fashion so as to take into consideration the amount of shrinkage that will occur when the fabric was subjected to a subsequent heat treatment. The yarn used in producing the fabric shown in FIG. 1 was a 20/2 denier yarn and, as can be seen, the two filament yarns follow substantially even and uniformly curving lines in forming stitch loops 10 in the wales W1–W4 in courses C1–C3. It is clearly evident that there is no crimp in the yarn which would tend to place tension on the yarn strands and hold them in position so that the various filaments in the stitch loops 10 could easily be snagged and pulled from the fabric with such snagging or pulling also tending to rob lengths of yarn from adjacent stitch loops in the courses which comprise the fabric.

Figure 2:
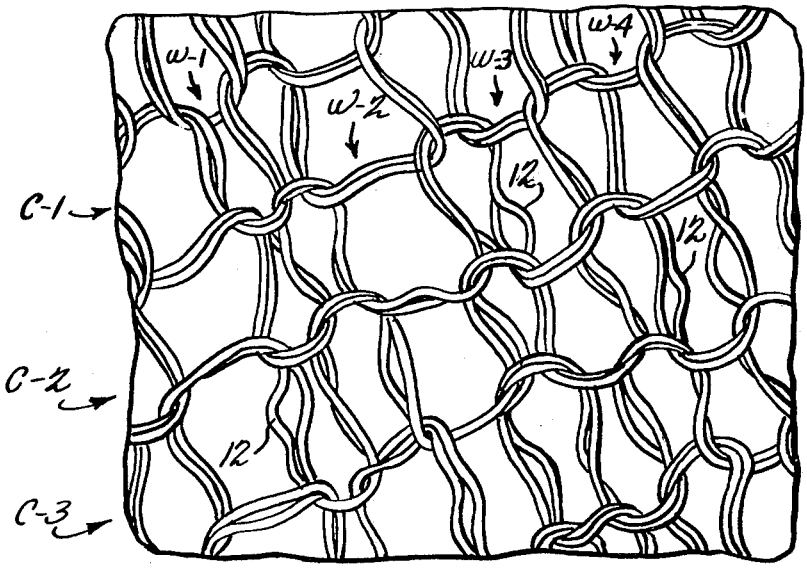
FIG. 2 is an enlarged fragmentary view of a portion of a garment made from yarn as in FIG. 1 but which has been finished in a normal manner.

FIG. 2 is a photomicrograph tracing of the fabric set forth in FIG. 1, again made from 20/2 denier yarn, but subsequent to normal finishing procedures to which the fabric in FIG. 1 was subjected. It can be seen, that the yarn has now had crimp developed therein and that the stitch loops are no longer regular and uniform but in fact have become distorted. However, the two filaments seem to be by-and-large still lying adjacent each other although there are areas where, due to development of the latent crimp in the yarn, the filaments are separated from each other. Certainly, the wale and course structure is no longer even and uniform as in FIG. 1. There are some areas in the yarns which exhibit, relative to FIG. 1, crimped areas as at 12 which tend to provide some resistance to yarns being pulled from the fabric so as to help make the fabric resistant to picking and snagging.

Figure 3:
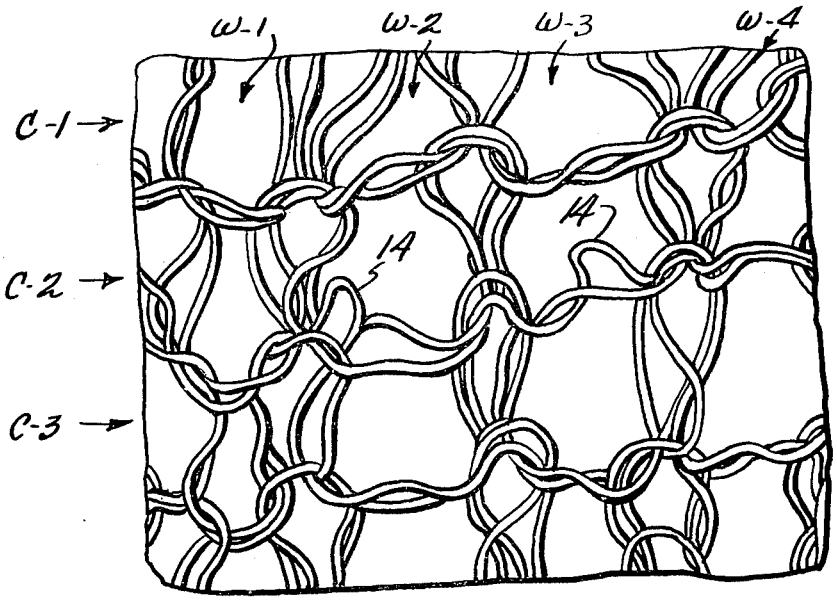
FIG. 3 is an enlarged fragmentary view of a portion of a knitted greige garment in which the yarn is shown in the form of stitch loops, the yarn having been pretreated according to the knit-de-knit process according to the present invention prior to the formation of this fabric.

Turning now to FIG. 3, the fabric shown there is again made of the same 20/2 denier yarn and the fabric as shown is prior to any subsequent finishing steps normally associated with fabric construction and is a greige fabric. The yarn, however, is yarn which has been produced according to the process previously described hereinbefore and is to be contrasted with the essentially greige yarn shown in FIG. 1. It is evident that the wales W1–W4 in the garment as well as the courses C1–C3 are very highly distorted even when compared with the finished fabric made from the conventional greige bicomponent, self-crimping yarn shown in FIG. 2. Many more curls and crimps are shown as at 14 which are far more exaggerated than in the fabric shown in FIG. 2. Therefore, the pretreated self-crimping, bicomponent yarn even in the greige fabric shown in FIG. 3 exhibits far more resistance to snagging and pulling than do the structures set forth in FIGS. 1 and 2. Further, the two filaments in the yarns do not follow each other in a regular uniform fashion but follow different paths and have areas where the exaggerated crimps cause wide separations between the filaments. The crimped areas 14 are believed to be crimps inserted during the knit-de-knit processing to which the yarn was subjected and it is these crimped areas which cause the stitch loops to contract into the form shown in FIG. 3 which render the yarns even in this greige form resistant to snagging and picking.

Figure 4:
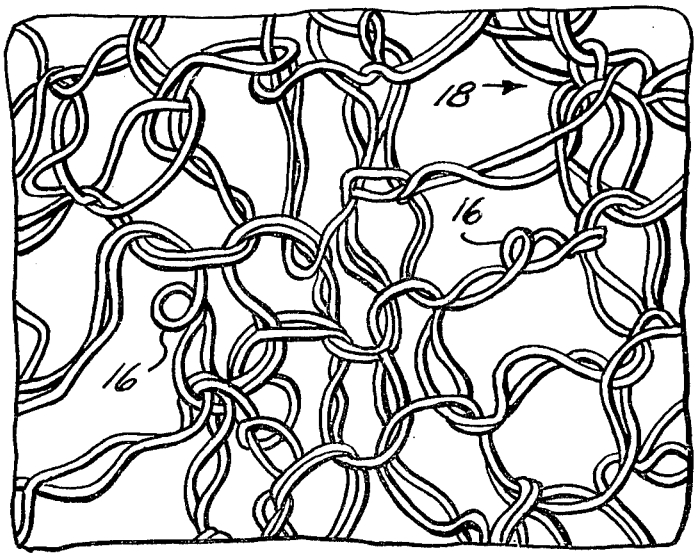
FIG. 4 is an enlarged fragmentary view of a portion of the fabric shown in FIG. 3 following normal finishing procedures and illustrating additional levels of crimp which has been imparted to the yarn.

FIG. 4 shows the fabric of FIG. 3 again following normal finishing procedures to which the fabric of FIG. 3 was subjected. It is clear that even additional development of the latent crimp characteristic or nature of the yarn has been achieved. In some places, such as at 16, individual filaments within the yarn have been so distorted that complete 360° coils have been formed therein. Further, the wale and course structure becomes very contracted, as for example at 18, which creates a great deal of tension in the yarn which increases the snag and pick resistance of the fabric. The finished fabric shown in FIG. 4 exhibits not only the crimp developed during the knit-de-knit process as described herein, but also additional crimping which is achieved in the yarn due to the finishing procedures used on the fabric made from the yarn subjected to the knit-de-knit processing. Thus, the yarn used in the fabric shown in FIG. 4 has crimps and curled areas therein which have not only been produced by the initial knit-de-knit processing but also secondary crimp development achieved during subsequent finishing of greige fabric made from precrimped yarn.

Thus, the foregoing specification has described a method for processing self-crimping bicomponent and biconstituent yarns via a knit-de-knit process which renders such yarns suitable for use as conventional yarns in the formation of fabric and/or garments. In addition, a novel yarn has been achieved which exhibits great resistance to snagging and picking when later used as a greige yarn in the production of garments and fabrics due to the development of crimp in that yarn during the knit-de-knit process. Unexpectedly, that yarn exhibits even greater resistance to snagging and picking as a result of the final finishing operations to which that greige fabric is subjected. The yarn finally developed not only exhibits crimps created by the knit-de-knit process but also natural or self-forming crimps, created by the differential shrinkage in each fiber. The combination of these two crimps, in the yarn produces a final finished fabric which exhibits a high degree of pick resistance thereby improving the wearability of garments and fabrics made therefrom.

While the present invention has been described in connection with a preferred embodiment with respect to the process and yarn set forth herein, it is to be understood that the present invention is not to be limited thereto but, on the contrary, is intended to cover other various modifications included within the spirit and scope of the appended claims.

What I claim is:

1. A method for producing preshrunk continuous bicomponent thermoplastic yarns having increased pick and snag resistance when used to produce greige fabric, said method comprising the steps of:

knitting a tubular sleeve of continuous bicomponent thermoplastic yarn in greige form on a circular knitting machine having a revolving knitting head provided with less than four hundred needles;

controlling the tension on the yarn being supplied to the knitting machine so as to produce a predetermined number of crimps along the length of the yarn formed into the tubular sleeve, the number of said crimps ranging from about 16 to about 24 crimps per thread line inch;

collecting the knit tubular sleeve in the form of a fabric roll and controlling the collection of the knit tubular sleeve so that the fabric roll has an internal diameter of at least eight inches;

autoclaving the fabric roll at a temperature ranging between about 212° F. to about 265° F. to equalize the temperature through the fabric roll so that the yarn therein will be equally heated for a period ranging from about 10 minutes to about 45 minutes so as to simultaneously shrink the yarn and set crimps therein; and unraveling the knit tubular sleeve and collecting the preshrunk, crimped and set yarn.

2. The process as in claim 1 wherein the circular knitting machine used to knit the tubular sleeve preferably employs a predetermined number of needles ranging between 210 and 390 needles.

3. The process as set forth in claim 1 wherein the number of needles employed is preferably 340.

4. The process as in claim 1 wherein the step of controlling the yarn tension during knitting further includes the step of feeding yarn at a rate varying between about 27.5 inches to about 34 inches per revolution of the circular knitting machine head.

5. The process as set forth in claim 1 wherein the step of collecting the knit tubular fabric forms a fabric roll having an internal diameter of ten inches.

6. The process as set forth in claim 1 wherein the autoclaving is preferably performed at temperature of about 235° F. for a period of about 45 minutes.

7. The process as set forth in claim 1 wherein the unraveling yarn is collected in the form of packages.

8. The process as set forth in claim 1 wherein the unraveling yarn is collected in the form of cones.

* * * * *